US011178926B2

(12) United States Patent
Renner

(10) Patent No.: US 11,178,926 B2
(45) Date of Patent: Nov. 23, 2021

(54) BELT STRAP INCLUDING ALTERNATING LINK SEGMENTS

(71) Applicant: William T Renner, Plymouth, MI (US)

(72) Inventor: William T Renner, Plymouth, MI (US)

( * ) Notice: Subject to any disclaimer, the term of this patent is extended or adjusted under 35 U.S.C. 154(b) by 821 days.

(21) Appl. No.: 15/828,861

(22) Filed: Dec. 1, 2017

(65) Prior Publication Data

US 2019/0166937 A1 Jun. 6, 2019

(51) Int. Cl.
*A41F 9/00* (2006.01)
*A44C 5/02* (2006.01)
*A44C 5/10* (2006.01)

(52) U.S. Cl.
CPC ..... *A41F 9/002* (2013.01); *A44C 5/025* (2013.01); *A44C 5/102* (2013.01)

(58) Field of Classification Search
CPC . A41F 9/00; A41F 9/002; A44C 5/025; A44C 5/10; A44C 5/0053; A44C 5/0061; A44C 5/102; A44C 5/105; A44C 5/107; A44C 5/02; A44C 13/00; A44C 11/00; A01D 27/00; B25H 3/00; F41D 33/046; B62D 55/08; F16G 13/00
See application file for complete search history.

(56) References Cited

U.S. PATENT DOCUMENTS 189,986 A * 4/1877 Armstrong ..... A41F 9/002 2/339
190,535 A * 5/1877 Armstrong ..... A41F 9/002 2/321
1,822,393 A * 9/1931 Fassnacht ..... A44C 5/02 59/80
1,847,182 A * 3/1932 Heyer ..... A41F 9/002 2/322
1,847,901 A * 3/1932 Roy ..... A44C 5/02 59/80
2,090,789 A * 8/1937 Forstner ..... A41F 9/002 2/300
2,451,397 A * 10/1948 Marquardt ..... A41F 9/002 2/338
2,586,758 A * 2/1952 Zerr ..... A44C 11/005 24/518
2,587,490 A 2/1952 Krieger
2,898,603 A 8/1959 Epstein
2,928,100 A * 3/1960 Gagnon ..... A41F 9/002 2/339

(Continued)

OTHER PUBLICATIONS

Ostan Men's Stainless Chain Link Bracelet, Amazon.com Listing, Printed Nov. 3, 2017.

*Primary Examiner* — Clinton T Ostrup
*Assistant Examiner* — Andrew Wayne Sutton
(74) *Attorney, Agent, or Firm* — Mitchell Law PLLC; Matthew W. Mitchell

(57) ABSTRACT

A belt is configured to be worn around a waistline of a pair of pants. The belt includes a belt buckle located at a first terminal end of the belt, a belt strap end segment including at least two adjoined link sections at a second terminal end of the belt, and a belt strap middle portion extending between the belt buckle and the belt strap end segment and including a plurality of binary, repeating, alternating belt strap component segments of two varieties, a first variety including a plurality of stacked, unconnected link sections and second variety including a plurality of stacked, adjoined link sections.

2 Claims, 5 Drawing Sheets

(56) References Cited

U.S. PATENT DOCUMENTS

| | | | | | |
|---|---|---|---|---|---|
| 3,724,204 | A * | 4/1973 | Frederick | A44C 5/102 | 59/80 |
| 4,095,415 | A | 6/1978 | Bower | | |
| 5,154,047 | A * | 10/1992 | Takagi | A44C 5/107 | 59/78 |
| 5,689,867 | A * | 11/1997 | Katz | A44C 5/185 | 24/265 B |
| 6,170,250 | B1 * | 1/2001 | Hara | A44C 5/107 | 59/80 |
| 8,425,274 | B1 * | 4/2013 | Ratcliff | A41C 3/0028 | 450/86 |

* cited by examiner

BELT STRAP INCLUDING ALTERNATING LINK SEGMENTS

TECHNICAL FIELD

This disclosure is related to a belt used to secure pants to a wearer, in particular, to a belt constructed with alternating bands of free links and joined links.

BACKGROUND

The statements in this section merely provide background information related to the present disclosure. Accordingly, such statements are not intended to constitute an admission of prior art.

Belts are used to secure pants to a wearer by providing tensile force around a waist of the wearer. Belts are typically made of leather or some other flexible material that conforms to the shape of the wearer.

SUMMARY

A belt is configured to be worn around a waistline of a pair of pants. The belt includes a belt buckle located at a first terminal end of the belt, a belt strap end segment including at least two adjoined link sections at a second terminal end of the belt, and a belt strap middle portion extending between the belt buckle and the belt strap end segment and including a plurality of binary, repeating, alternating belt strap component segments of two varieties, a first variety including a plurality of stacked, unconnected link sections and second variety including a plurality of stacked, adjoined link sections.

BRIEF DESCRIPTION OF THE DRAWINGS

One or more embodiments will now be described, by way of example, with reference to the accompanying drawings, in which.

DETAILED DESCRIPTION

A belt is configured with alternating belt strap segments of two varieties, a first variety comprising a plurality of stacked, unconnected link sections and second variety comprising a plurality of stacked, adjoined link sections. Link sections are each rigid portions which can be connected end to end, such that a tensile force can be applied longitudinally through a series of connected link sections. Such a series of connected link sections can be connected laterally to another series of connected link sections to provide a wide belt strap portion. The alternating segments of free links and adjoined links provide a combination of rigidity needed to cleanly thread the belt through belt loops while providing flexibility to allow for comfortable wear upon the user.

Such a belt strap can be advantageous over traditional belt designs. For example, leather belts can stretch and deform over time. Belts with metal links are less prone to wear and tear. Further, objects such as cell phones, wallet straps, and key rings can more easily be hung from the connected links of the disclosed belt than from a conventional belt.

Figure 1:
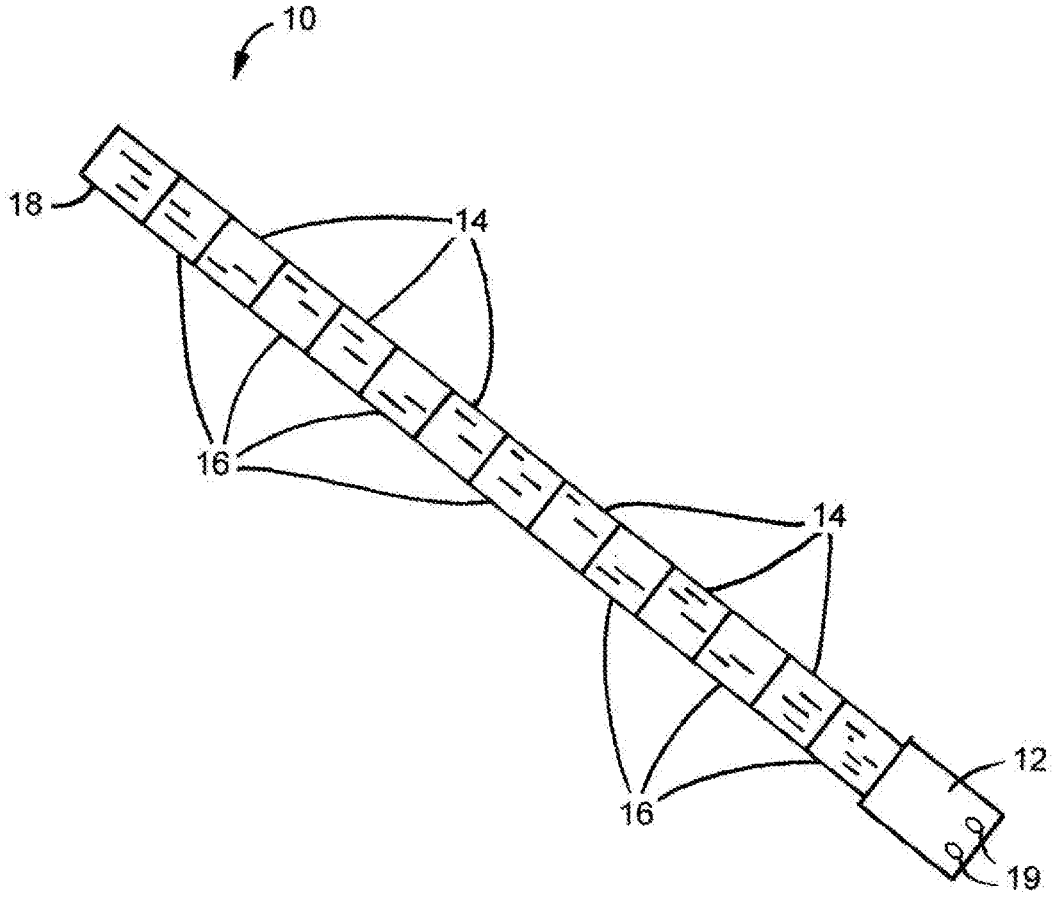
FIG. 1 illustrates a belt constructed with alternating bands of free links and joined links, in accordance with the present disclosure.

Referring now to the drawings, wherein the showings are for the purpose of illustrating certain exemplary embodiments only and not for the purpose of limiting the same, FIG. 1 illustrates a belt constructed with alternating bands of free links and joined links. Belt 10 is illustrated including a belt buckle 12 at a first terminal end of the belt, a belt strap end segment 18 comprising at least two adjoined link sections at a second terminal end of the belt. The belt 10 further includes a belt strap middle portion extending between belt buckle 12 and belt strap end segment 18. The middle portion includes a plurality of binary, repeating, alternating belt strap component segments of two varieties, a first variety, belt segment 14, including a plurality of stacked, unconnected link sections and second variety, belt segment 16, comprising a plurality of stacked, adjoined link sections.

Belt buckle 12 includes two hooks 19 configured to latch onto belt strap end segment 18 to secure the belt around the waistline of a wearer.

Figure 2:
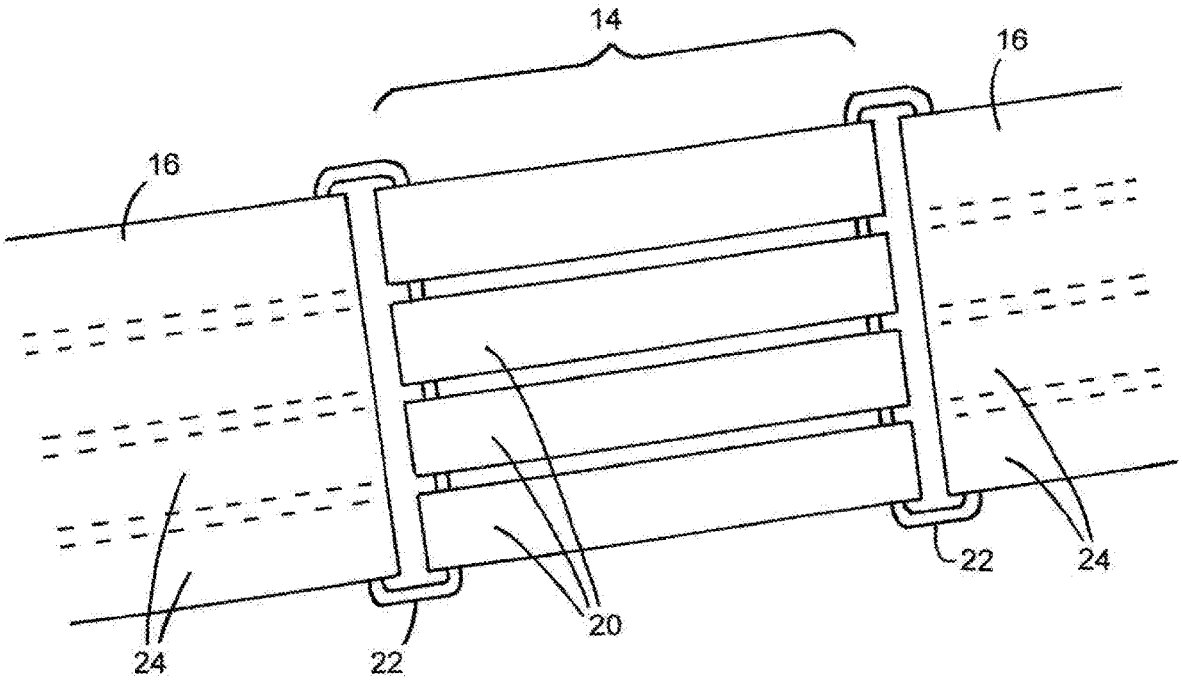
FIG. 2 illustrates the alternating bands of free and joined links of FIG. 1 in detail, in accordance with the present disclosure.

FIG. 2 illustrates the alternating bands or segments of free and joined links of FIG. 1 in detail. Each belt segment 14 includes a plurality of stacked, unconnected link sections 20. Link sections 20 can include one of any of a number of link configurations. Link sections 20 can move independently of each other. Within belt 10, this provides greater flexibility than if just repeating belt segments 16 were used in the belt.

Each belt segment 16 includes a plurality of stacked, adjoined link sections 24. The adjoined link sections 24 can appear similar to link sections 20. The links 24 can be created as part of a single segment 16, or individual link sections 24 can be joined together, for example, by welding, gluing, or other process.

Belt segments 14 and belt segments 16 are joined together and are able to pivot in relation to each other. Many different joining mechanisms or joining methods can be used between belt segments. In FIG. 2, connecting loops 22 join belt segments 14 and belt segments 16.

Figure 3:
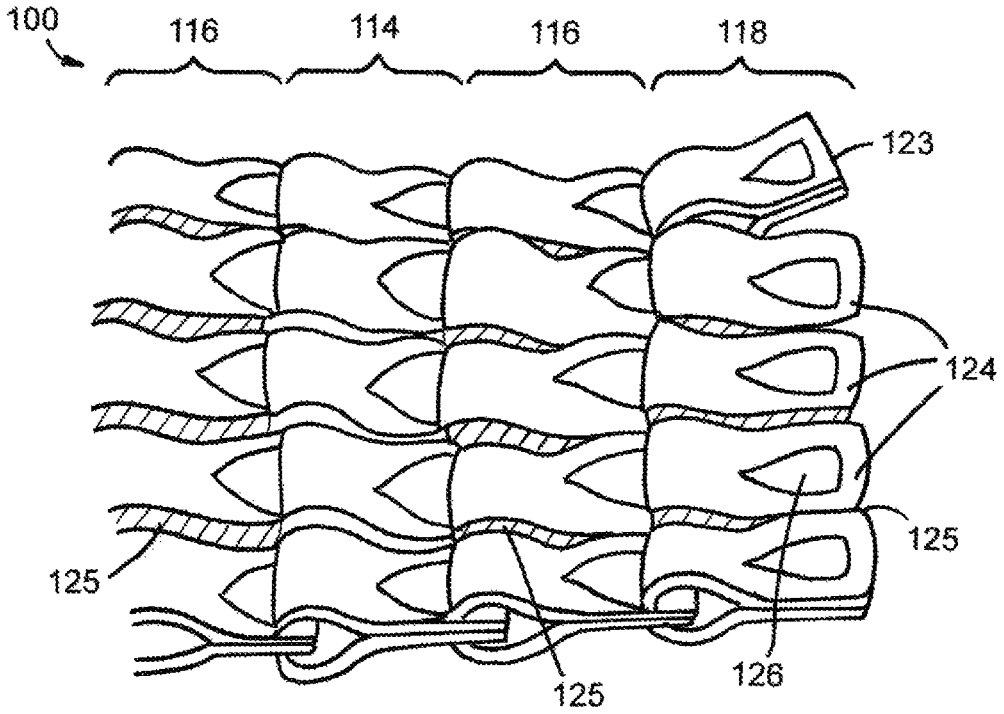
FIG. 3 illustrates an end portion of joined links for the belt of FIG. 1 including buckle hook retention holes, in accordance with the present disclosure.

FIG. 3 illustrates an end portion of joined links for the belt of FIG. 1 including buckle hook retention holes. Belt strap end segment 18 is illustrated attached to a belt segment 14 with a connecting loop 22. In other embodiments, belt strap end segment 18 can be attached to a belt segment 16. Belt strap end segment 18 is illustrated with four adjoined link sections 24. Between link sections 24, six buckle hook retention holes 26 are illustrated configured to receive hooks 19 of the buckle 12 of FIG. 1.

Figure 4:
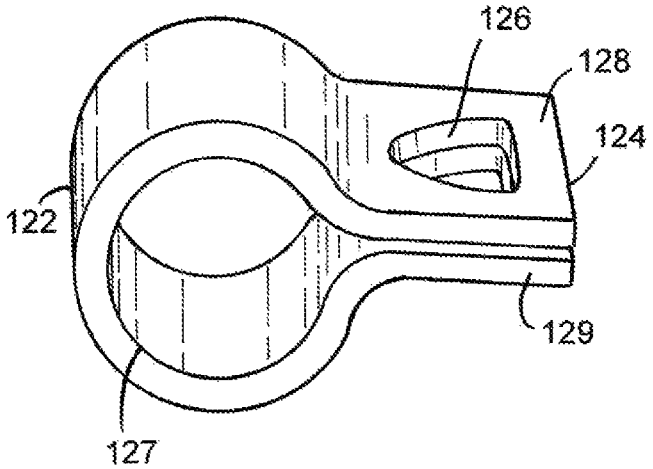
FIG. 4 illustrates an alternate end portion of joined links for a belt, including one free link configured to aid in threading the belt through belt loops on a pair of pants, in accordance with the present disclosure.

FIG. 4 illustrates an alternate end portion of joined links for a belt, including one free link configured to aid in threading the belt through belt loops on a pair of pants. Belt strap end segment 18' is illustrated attached to a belt segment 14 with a connecting loop 22. In other embodiments, belt strap end segment 18' can be attached to a belt segment 16. Belt strap end segment 18 is illustrated with three adjoined link sections 24 and one unconnected link section 28. Between link sections 24, three buckle hook retention holes 26 are illustrated configured to receive hooks of an alternative buckle configuration with a single hook.

Figure 5:
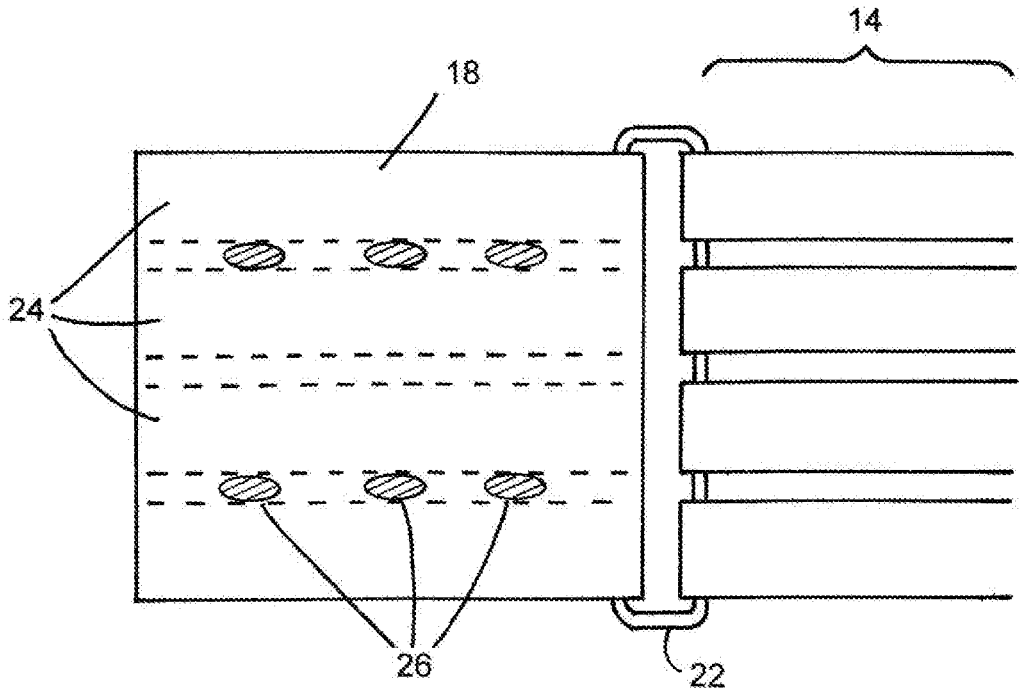
FIG. 5 illustrates an exemplary alternative embodiment of belt constructed with alternating bands of free links and joined links, in accordance with the present disclosure.

FIG. 5 illustrates an exemplary alternative embodiment of a belt constructed with alternating bands of free links and joined links. Belt 100 is illustrated including alternating bands of segments 116 with adjoined link sections 124 and segments 114 with unconnected link sections 124. Belt 100 further includes belt strap end segment 118 including a plurality of joined link sections 124 or links joined by exemplary welds 125, the belt strap end segment 118 being connected to one of sections 116. Belt strap end segment 118 further includes an exemplary free link 123 configured to ease insertion of belt strap end segment 118 into a belt loop of a pair of pants. Each link section 124 on segments 114 and 116 includes a hole 126 though which a next link section in a neighboring segment is threaded.

Figure 6:
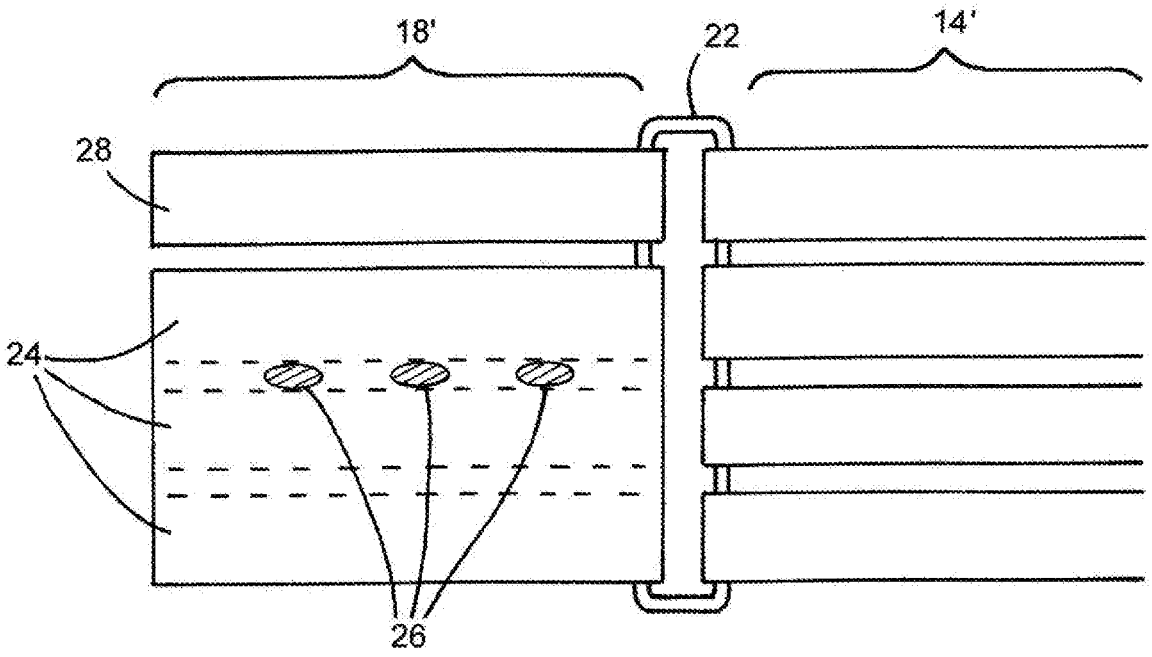
FIG. 6 illustrates one of the links of the embodiment of FIG. 5, in accordance with the present disclosure.

FIG. 6 illustrates one of the links of the embodiment of FIG. 5. Link section 124 is illustrated including hole 126. Link section 124 is created by bending a flat piece of metal, joining tabs 128 and 129. When the link section is created, hole 127 is created in a perpendicular direction to hole 126, with arcuate link portion 122 forming a curved portion around hole 127. Link section 124 of FIG. 6 is illustrated in isolation. During the construction process, neighboring link sections 124 are threaded together, with an arcuate portion 122 of a first link section 124 being threaded through hole 126 of a second link section 124.

Figure 7:
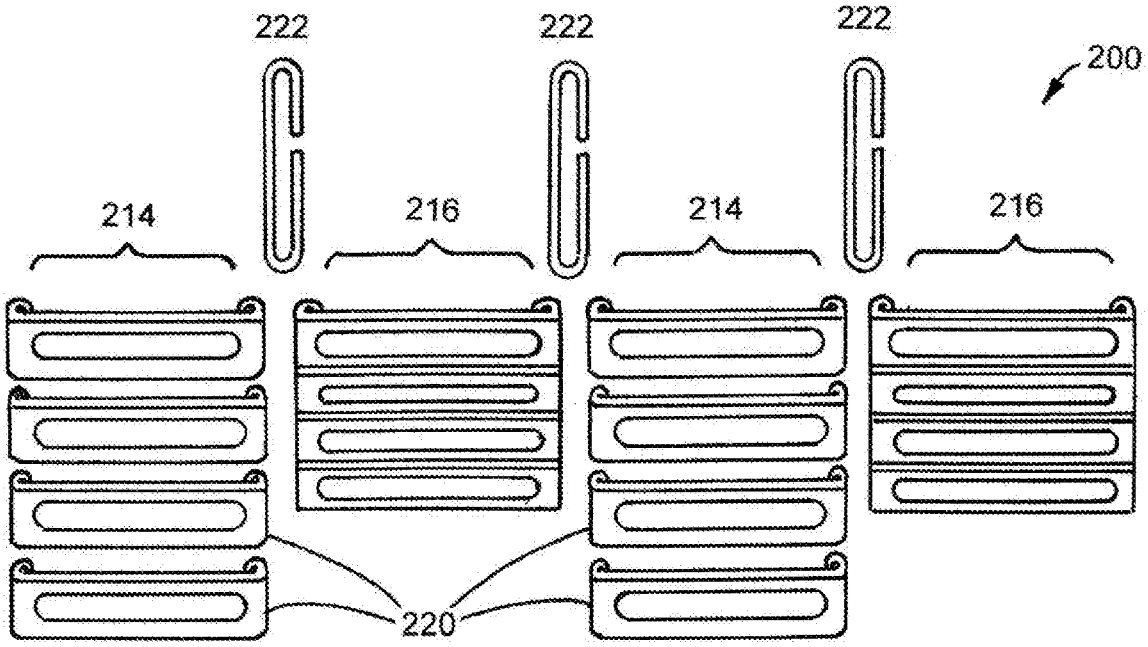
FIG. 7 illustrates an additional exemplary alternative embodiment of belt constructed with alternating bands of free links and joined links, in accordance with the present disclosure.

FIG. 7 illustrates an additional exemplary alternative embodiment of belt constructed with alternating bands of free links and joined links. Belt 200 is illustrated including alternating segments 216 of adjoined link sections 220 and segments 214 of unconnected link sections 220. Connecting loops 222 are illustrated connecting link segments 214 and 216. Individual link sections 220 can be constructed of any material useful for belt strap construction, including metal, leather, reinforced leather, polymers, or any similar material.

Belt straps herein can be constructed of identical link sections, with some of the link sections being joined together. Belt straps alternatively can be constructed of alternating bands of free link sections and single piece adjoined link segments, wherein these single piece adjoined link segments can be configured to look similar to stacked segments of the free link sections.

It will be appreciated that the components of the disclosed belt can be constructed of any of a number of materials or combination of materials. Bronze, silver, gold, other metals such as stainless steel, polymers, leather, and wood can be used to make belt components and/or belt buckle components. The belt buckle can be configured to receive an engraved image. any number of links can be used in a single section of links, and any number of sections of links can be utilized in the belt.

The disclosure has described certain preferred embodiments and modifications of those embodiments. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A belt configured to be worn around a waistline of a pair of pants, comprising:

a belt buckle located at a first terminal end of the belt;

a belt strap end segment comprising at least two adjoined link sections at a second terminal end of the belt;

a plurality of identical link sections; and a belt strap middle portion extending between the belt buckle and the belt strap end segment and comprising a plurality of binary, repeating, alternating belt strap segments of two varieties, a first variety comprising a plurality of stacked, unconnected link sections and second variety comprising a plurality of stacked, adjoined link sections;

wherein the plurality of stacked, unconnected link sections comprise a first portion of the plurality of identical link sections;

wherein the plurality of stacked, adjoined link sections comprise a second portion of the plurality of identical link sections;

wherein each of the identical link sections comprise a bent piece of metal including two joined tabs, a first hole oriented in a first direction, and a second hole oriented in a second direction; and wherein the first direction is perpendicular to the second direction.

2. The belt of claim 1, wherein the alternating belt strap component segments are connected together with connecting loops.

* * * * *